US007506828B2

(12) United States Patent
Ayers et al.

(10) Patent No.: US 7,506,828 B2
(45) Date of Patent: Mar. 24, 2009

(54) QUICK INSTALLATION NOZZLE ASSEMBLY FOR USE WITHIN HOT MELT ADHESIVE DISPENSING MODULES

(75) Inventors: Andrew S. Ayers, Old Hickory, TN (US); Scott J. Hudanish, Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 350 days.

(21) Appl. No.: 10/972,210

(22) Filed: Oct. 25, 2004

(65) Prior Publication Data

US 2006/0102754 A1 May 18, 2006

(51) Int. Cl.
*B05B 1/00* (2006.01)

(52) U.S. Cl. ..... 239/600; 239/548; 239/589

(58) Field of Classification Search ..... 239/135, 239/290, 533.15, 548, 549, 556–558, 567, 239/583, 584, 600, 589
See application file for complete search history.

(56) References Cited

U.S. PATENT DOCUMENTS 2,881,826 A * 4/1959 Spies, Jr. ..... 239/424.5
3,510,065 A * 5/1970 Gigantino et al. ..... 239/590
3,851,468 A * 12/1974 Frankle et al. ..... 60/258
4,139,160 A * 2/1979 Rood ..... 239/600
4,334,637 A * 6/1982 Baker et al. ..... 222/146.2
4,365,758 A * 12/1982 Schaming ..... 239/590
4,785,996 A * 11/1988 Ziecker et al. ..... 239/298
5,169,071 A * 12/1992 Boger et al. ..... 239/296
5,194,115 A * 3/1993 Ramspeck et al. ..... 156/578
5,337,961 A * 8/1994 Brambani et al. ..... 239/397.5
5,868,316 A * 2/1999 Scott ..... 239/73
5,873,528 A * 2/1999 Lewis et al. ..... 239/135
6,607,104 B2 8/2003 McGuffey
6,688,498 B1 2/2004 McGuffey
2004/0195355 A1 * 10/2004 Bolyard et al. ..... 239/128

* cited by examiner

*Primary Examiner*—Len Tran
*Assistant Examiner*—Jason J Boeckmann
(74) *Attorney, Agent, or Firm*—Law Offices of Steven W. Weinrieb

(57) ABSTRACT

A quick installation hot melt adhesive dispensing nozzle assembly, for use in connection with hot melt adhesive dispensing modules, comprises a nut member which is adapted to threadedly engage a hot melt adhesive dispensing module seat member, and a hot melt adhesive dispensing nozzle member which is initially assembled together with the nut member. A plurality of orientation pins are adapted to effectively interconnect the nozzle member to the dispensing module seat member such that a particular angular orientation of the nozzle member, and therefore the angular orientation of the dispensing ports defined within the nozzle member, may be predeterminedly positioned with respect to the longitudinal axis of the hot melt adhesive dispensing module. The nut member is rotatable relative to the nozzle member such that the nut member can be threadedly engaged upon the hot melt adhesive dispensing module seat member while the angular orientation or disposition of the nozzle member is maintained at its predetermined position with respect to the longitudinal axis of the hot melt adhesive dispensing module as a result of the interconnection effectively defined between the nozzle member and the hot melt adhesive dispensing module seat member by means of the orientation pins. In this manner, only the nut member needs to be grasped either manually, or by means of a single tool, in order to achieve the fixed installation of the nozzle member upon the hot melt adhesive dispensing module.

26 Claims, 3 Drawing Sheets

QUICK INSTALLATION NOZZLE ASSEMBLY FOR USE WITHIN HOT MELT ADHESIVE DISPENSING MODULES

FIELD OF THE INVENTION

The present invention relates generally to fluid dispensing nozzle assemblies, and more particularly to a new and improved quick installation hot melt adhesive dispensing nozzle assembly, for use in connection with hot melt adhesive dispensing modules, wherein a nut member, which is adapted to threadedly engage a dispensing module seat member, and a dispensing nozzle member are initially assembled together such that the nut and nozzle members cannot be readily or easily separated from each other, wherein a plurality of orientation pins are adapted to effectively interconnect the nozzle member to the dispensing module seat member such that a particular angular orientation of the nozzle member, and therefore the angular orientation of the fluid dispensing ports defined within the nozzle member, may be predeterminedly chosen, selected, and set with respect to the longitudinal axis of the dispensing module, and wherein further, the nut member is rotatable relative to the nozzle member such that the nut member may be threadedly engaged upon the dispensing module seat member while the angular orientation or disposition of the nozzle member is maintained at its predetermined or preset position or setting, with respect to the longitudinal axis of the dispensing module, as a result of the interconnection effectively defined between the nozzle member and the dispensing module seat member by means of the aforenoted orientation pins. In this manner, only the nut member needs to be grasped either manually, or by means of a single tool, in order to achieve the fixed installation of the nozzle member upon the hot melt adhesive dispensing module.

BACKGROUND OF THE INVENTION

In conventional hot melt adhesive dispensing module systems, a hot melt adhesive dispensing nozzle member is adapted to be fixedly mounted upon a hot melt adhesive dispensing module as a result of the hot melt adhesive dispensing nozzle member being effectively mounted upon or operatively engaged by an internally threaded nut member, and subsequently, the internally threaded nut member is threadedly engaged with an externally threaded body portion of a hot melt adhesive dispensing module seat member so as to fixedly capture the hot melt adhesive dispensing nozzle member therebetween. The hot melt adhesive dispensing nozzle member is provided with a predetermined number of hot melt adhesive dispensing or discharge ports arranged within a predetermined pattern, and therefore, it is imperative that, when the hot melt adhesive dispensing nozzle member is completely or fully mounted upon the hot melt adhesive dispensing module, the hot melt adhesive dispensing nozzle member will be disposed at a predetermined angular position or orientation with respect to the longitudinal axis of the hot melt adhesive dispensing module in order to permit the hot melt adhesive dispensing or discharge ports of the hot melt adhesive dispensing nozzle member to achieve a predeterminedly desired hot melt adhesive dispensing pattern upon a particular underlying substrate.

It is therefore to be appreciated that, when the internally threaded nut member is being threadedly engaged upon the externally threaded body portion of the hot melt adhesive dispensing module seat member, the installation personnel must employ, for example, a first wrench-type tool, or the like, for effectively engaging or grasping the hot melt adhesive dispensing nozzle member so as to ensure that the angular orientation of the hot melt adhesive dispensing nozzle member is in fact maintained or retained at the predeterminedly desired angular orientation with respect to the longitudinal axis of the hot melt adhesive dispensing module. In addition, in conjunction with the aforenoted use or employment of the first wrench-type tool or the like, the installation personnel must also employ a second wrench-type tool or the like for effectively engaging or grasping the internally threaded nut member so as to be able to rotate the same relative to the hot melt adhesive dispensing module seat member in order to achieve the threaded engagement of the internally threaded nut member upon the externally threaded body portion of the hot melt adhesive dispensing module seat member. This use or employment, and simultaneous manipulation of the two different wrench-type tools, in connection with both the hot melt adhesive dispensing nozzle member and the internally threaded nut member, is difficult and awkward to achieve, is tedious over time, and is time-consuming for the installation personnel.

A need therefore exists in the art for a new and improved quick installation hot melt adhesive dispensing nozzle assembly, for use in connection with hot melt adhesive dispensing modules, wherein, for example, the internally threaded nut member and the hot melt adhesive dispensing nozzle member are effectively connected together such that the resulting assembly can then be readily mounted upon the hot melt adhesive dispensing module seat member as a result of the use of only a single tool, or manual manipulation, which is adapted to operatively engage the internally threaded nut member in order to achieve the fixed installation of the hot melt adhesive dispensing nozzle member upon the hot melt adhesive dispensing module.

SUMMARY OF THE INVENTION

The foregoing and other objectives are achieved in accordance with the teachings and principles of the present invention through the provision of a new and improved quick installation hot melt adhesive dispensing nozzle assembly, for use in connection with hot melt adhesive dispensing modules, wherein the internally threaded nut member, which is adapted to threadedly engage the externally threaded body portion of the dispensing module seat member, and the hot melt adhesive dispensing nozzle member, are initially assembled together and are subsequently retained together by means of a suitable circlip such that the internally threaded nut member and the hot melt adhesive dispensing nozzle member cannot be readily or easily separated from each other. In addition, a plurality of orientation pins are adapted to effectively interconnect the hot melt adhesive dispensing nozzle member to the hot melt adhesive dispensing module seat member such that a particular angular orientation of the hot melt adhesive dispensing nozzle member, and therefore the angular orientation of the hot melt adhesive dispensing or discharge ports defined within the hot melt adhesive dispensing nozzle member, may be predeterminedly chosen, selected, and set with respect to the longitudinal axis of the dispensing module so as to achieve a predetermined hot melt adhesive dispensing pattern upon, for example, an underlying substrate.

Still further, the internally threaded nut member is rotatable relative to the hot melt adhesive dispensing nozzle member such that the internally threaded nut member may be threadedly engaged upon the externally threaded body portion of the hot melt adhesive dispensing module seat member while the angular orientation or disposition of the hot melt adhesive dispensing nozzle member is maintained at its predetermined or preset position or setting, with respect to the longitudinal axis of the hot melt adhesive dispensing module, as a result of the interconnection effectively defined between the hot melt adhesive dispensing nozzle member and the hot melt adhesive dispensing module seat member by means of the aforenoted orientation pins. In this manner, only the internally threaded nut member needs to be grasped either manually, or by means of a single tool, in order to achieve the fixed installation of the hot melt adhesive dispensing nozzle member upon the hot melt adhesive dispensing module. The external peripheral surface portion of the internally threaded nut member is preferably provided with a thermal protective ring member fabricated from a suitable plastic material, such as, for example, a polyetheretherketone (PEEK) polymer.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIGS. 1-4, is fixedly mounted.

DETAILED DESCRIPTION OF THE PREFERRED EMBODIMENT

Figure 3:
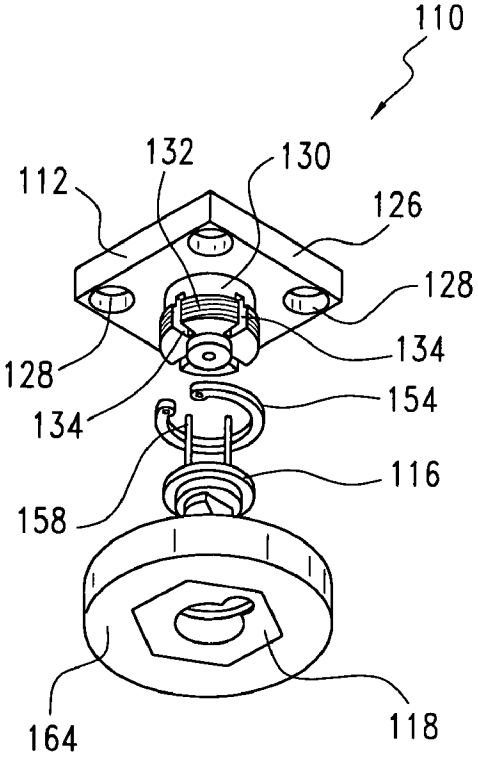
FIG. 3 is an exploded, bottom perspective view, corresponding to the exploded, top perspective view of FIG. 1 and the exploded, side elevation view of FIG. 2, of the new and improved quick installation hot melt adhesive dispensing nozzle assembly constructed in accordance with the principles and teachings of the present invention.
Figure 2:
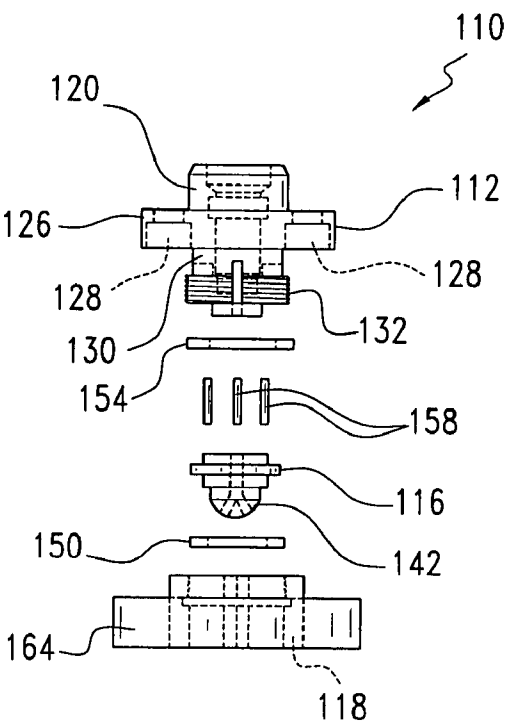
FIG. 2 is an exploded, side elevation view, corresponding to the exploded, top perspective view of FIG. 1, of the new and improved quick installation hot melt adhesive dispensing nozzle assembly constructed in accordance with the principles and teachings of the present invention.
Figure 1:
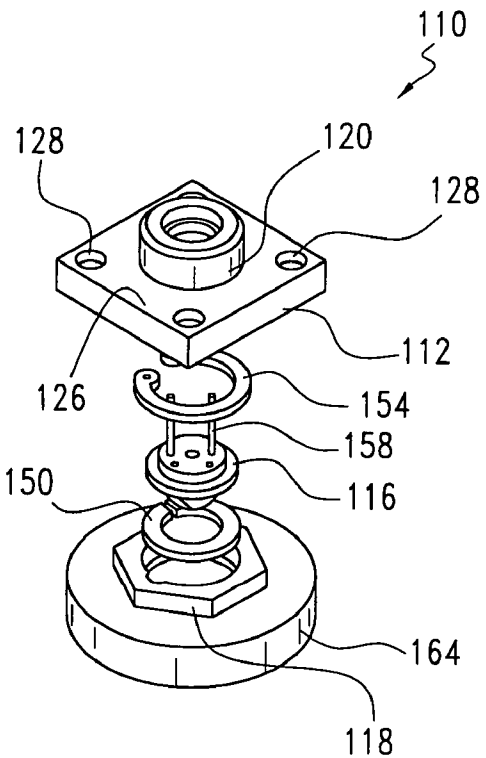
FIG. 1 is an exploded, top perspective view of a new and improved quick installation hot melt adhesive dispensing nozzle assembly constructed in accordance with the principles and teachings of the present invention and showing the cooperative parts thereof.

Referring now to the drawings, and more particularly to FIGS. 1-4 thereof, a new and improved quick installation hot melt adhesive dispensing nozzle assembly, constructed in accordance with the principles and teachings of the present invention and showing the cooperative parts thereof, is illustrated and is generally indicated by the reference character 110. It is seen that the new and improved quick release hot melt adhesive dispensing nozzle assembly 110, as constructed in accordance with the principles and teachings of the present invention, comprises three primary or major components, that is, a hot melt adhesive dispensing module seat member 112, which is adapted to be fixedly secured to a hot melt adhesive dispensing module 114 as illustrated within FIG. 5, a hot melt adhesive dispensing nozzle member 116 through which the hot melt adhesive, as supplied from the hot melt adhesive dispensing module 114, is adapted to be dispensed or discharged onto an underlying substrate, and a nut member 118 which is adapted to be threadedly engaged with, and secured upon, the hot melt adhesive dispensing module seat member 112 so as to, in turn, fixedly mount and secure the hot melt adhesive dispensing nozzle member 116 upon the hot melt adhesive dispensing module seat member 112 whereby the hot melt adhesive dispensing nozzle member 116 will be disposed in fluidic communication with the hot melt adhesive dispensing module 114.

Figure 5:
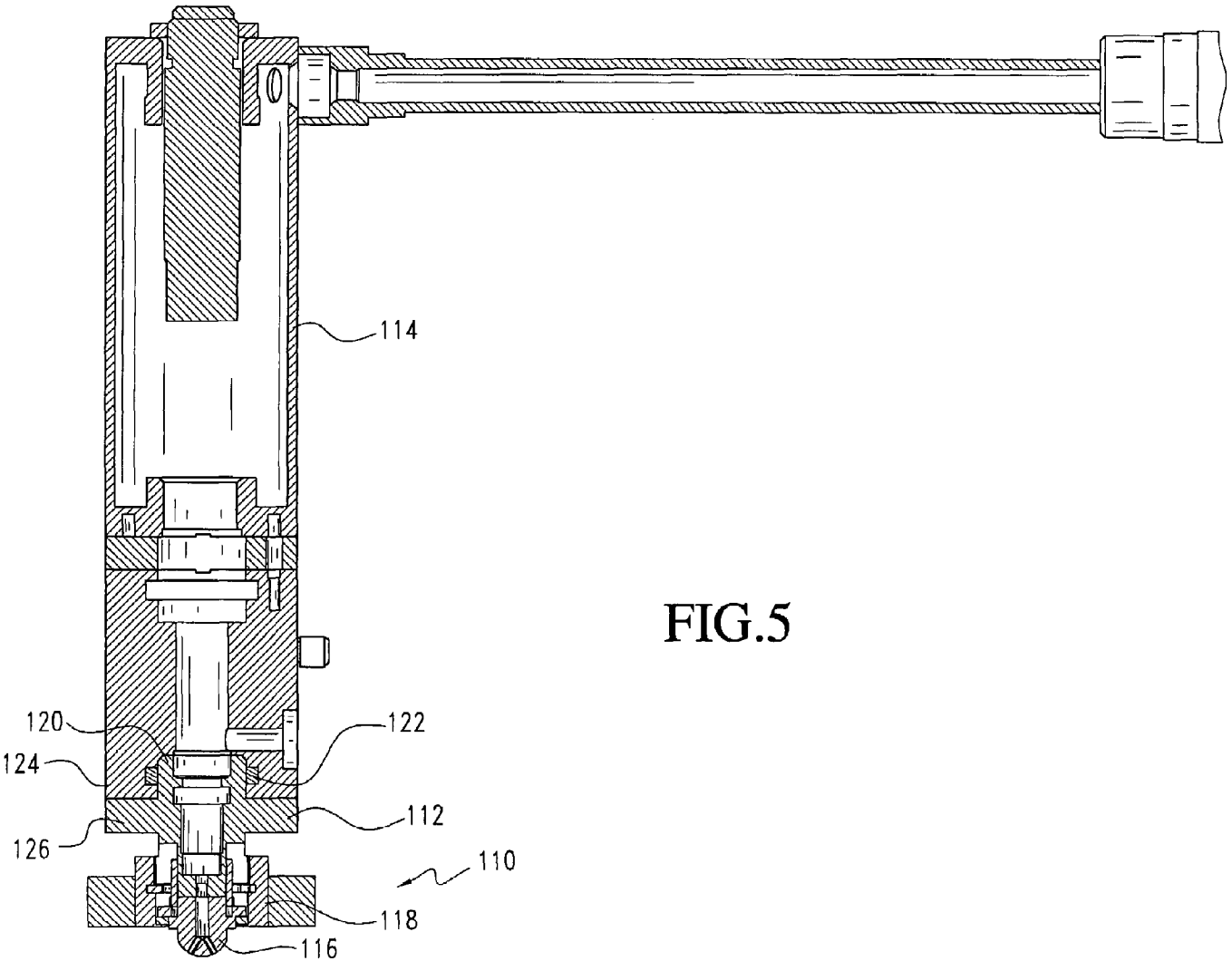
FIG. 5 is a cross-sectional view of a hot melt adhesive dispensing module within which the new and improved quick installation hot melt adhesive dispensing nozzle assembly of the present invention, as illustrated within

More particularly, it is seen that the hot melt adhesive dispensing module seat member 112 comprises an upper tubular body portion 120 which is adapted to be disposed within a recessed region 122 formed within a lower end portion 124 of the hot melt adhesive dispensing module 114, as illustrated within FIG. 5, so as to receive a supply of the hot melt adhesive being generated within the hot melt adhesive dispensing module 114, an intermediate mounting plate 126, having a substantially square-shaped cross-sectional configuration, which is adapted to be fixedly mounted upon the lower end portion 124 of the hot melt adhesive dispensing module 114 by means of a plurality of suitable bolts or other fasteners, not shown, which are adapted to be respectively inserted through a plurality of counterbored apertures 128 formed within the four corner regions of the intermediate mounting plate 126, and a lower tubular body portion 130 which has an annular flanged ring portion 132 integrally formed thereon. The external periphery of the annular flanged ring portion 132 is threaded, and a plurality of radially inwardly extending slots 134, such as, for example, four slots, are formed within the annular flanged ring portion 132 at equiangularly spaced positions disposed 90° apart.

Figure 4:
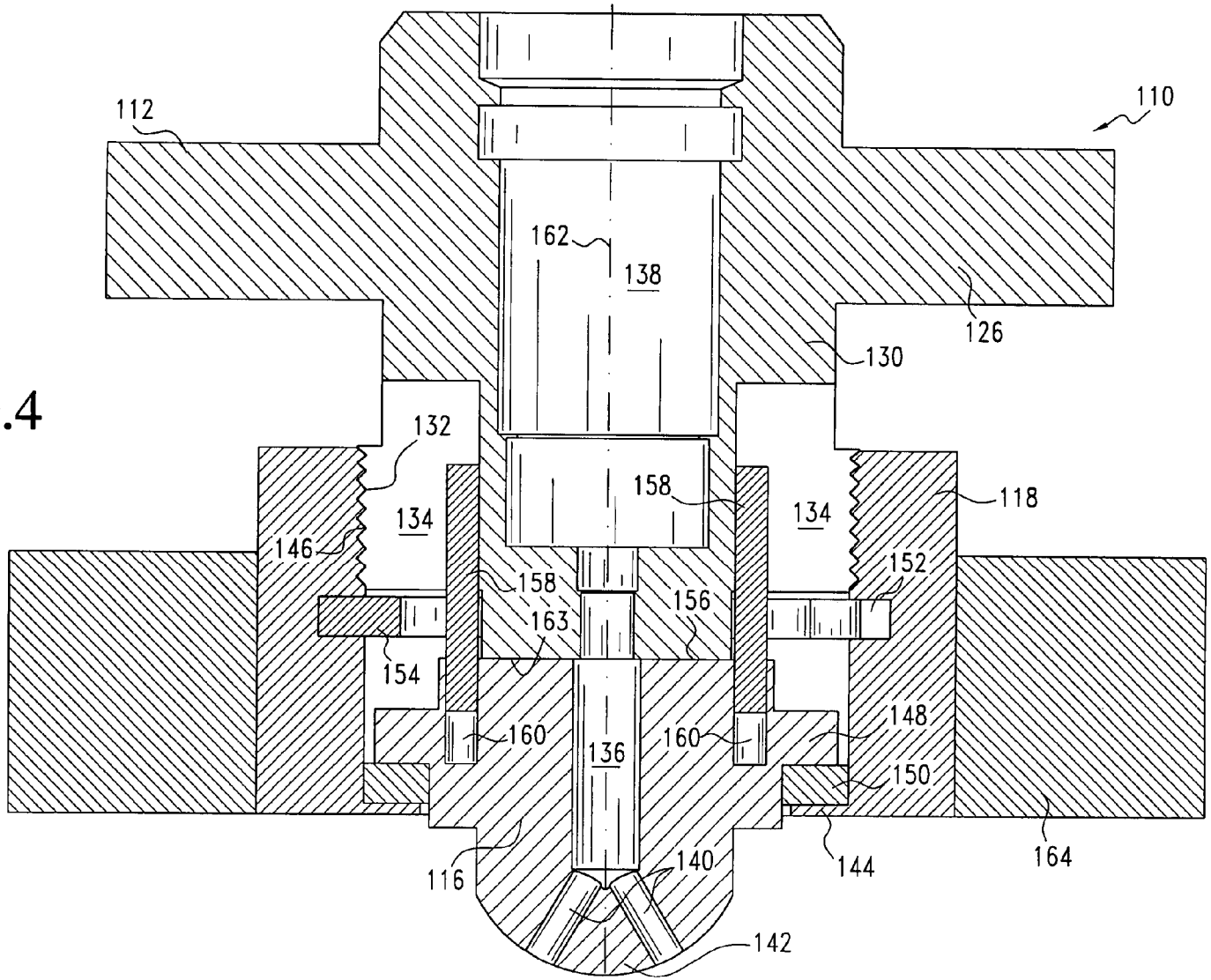
FIG. 4 is a cross-sectional, enlarged detail view of the new and improved quick installation hot melt adhesive dispensing nozzle assembly, as constructed in accordance with the principles and teachings of the present invention, and corresponding to the exploded views illustrated within FIGS. 1-3 but showing the cooperative parts thereof disposed in their assembled state.

As can best be appreciated from FIG. 4, the hot melt adhesive dispensing nozzle member 116 is seen to comprise an axially oriented central bore 136 which is adapted to be disposed in fluidic communication with an axially oriented central supply bore 138 formed within the hot melt adhesive dispensing module seat member 112, and a pair of hot melt adhesive dispensing or discharge passageways or ports 140, 140 which are disposed in fluidic communication with the axially oriented central bore 136 at their internal end portions, while the external end portions of the pair of hot melt adhesive dispensing or discharge passageways or ports 140, 140 open onto the external domed surface portion 142 of the hot melt adhesive dispensing nozzle member 116 so as to dispense or discharge a predeterminedly configured pattern of the hot melt adhesive material onto an underlying substrate. The nut member 118 is provided with an annular, radially inwardly extending flanged portion 144 upon the lower end portion thereof, and it is seen that the upper annular end portion of the nut member 118 is internally threaded, as at 146, so as to threadedly mate with the threads defined upon the external periphery of the annular flanged ring portion 132 of the lower tubular body portion 130 of the hot melt adhesive dispensing module seat member 112. It is further appreciated that the hot melt adhesive dispensing nozzle member 116 is integrally provided with a radially outwardly extending annular flanged portion 148, and this flanged portion 148 is effectively adapted to be seated or supported upon the aforenoted annular, radially inwardly extending flanged portion 144 of the nut member 118 when the hot melt adhesive dispensing nozzle member 116 is inserted into or disposed within the nut member 118 so as to permit the domed surface portion 142 of the hot melt adhesive dispensing nozzle member 116, within which the hot melt adhesive dispensing or discharge ports 140, 140 are defined, to project downwardly and outwardly through the open central portion of the nut member 118 so as to enable or facilitate the dispensing or discharge of the hot melt adhesive material onto the underlying substrate.

Continuing further, and with reference continuing to be made particularly to FIG. 4, it is seen that a spring washer 150, a BELLEVILLE® spring, or similar structural component, is adapted to be interposed between the underlying surface of the radially outwardly extending annular flanged portion 148 of the hot melt adhesive dispensing nozzle member 116 and the upper surface portion of the annular, radially inwardly extending flanged portion 144 of the nut member 118. In addition, it is also seen that the nut member 118 has an annular recess 152 defined within the inner peripheral wall portion thereof at an axial or elevational position which is just below the internally threaded portion 146 of the nut member 118, and an annular circlip 154 is adapted to be snap-fitted into the annular recess 152 defined within the inner peripheral wall portion of the nut member 118. As can best be appreciated from FIG. 4, in conjunction with the spring washer 150 or the like being disposed beneath the radially outwardly extending annular flanged portion 148 of the hot melt adhesive dispensing nozzle member 116 so as to be interposed between the underlying surface of the radially outwardly extending annular flanged portion 148 of the hot melt adhesive dispensing nozzle member 116 and the upper surface portion of the annular, radially inwardly extending flanged portion 144 of the nut member 118, the circlip 154 is adapted to be disposed above the upper surface portion 156 of the hot melt adhesive dispensing nozzle member 116 when the hot melt adhesive dispensing nozzle member 116 is inserted into or disposed within the nut member 118.

Accordingly, it can be further appreciated that the aforenoted structural components enable the hot melt adhesive dispensing nozzle member 116 and the nut member 118 to effectively be pre-assembled and connected together so as to form an integral assembly which may then be subsequently and easily mounted upon the hot melt adhesive dispensing module seat member 112 as a result of the threaded engagement defined between the internally threaded portion 146 of the nut member 118 and the externally threaded annular ring portion 132 of the lower tubular body portion 130 of the hot melt adhesive dispensing module seat member 112. More particularly, in forming the aforenoted assembly comprising the hot melt adhesive dispensing nozzle member 116 and the nut member 118, it can be appreciated that the spring washer 150 or the like is initially disposed within the nut member 118 so as to be seated and support upon the radially inwardly projecting flanged portion 144 of the nut member 118. The hot melt adhesive dispensing nozzle member 116 is then inserted into the nut member 118 such that the domed portion 142 of the hot melt adhesive dispensing nozzle member 116 projects downwardly and outwardly through the central open region of the nut member 118 while the radially outwardly projecting flanged portion 148 of the hot melt adhesive dispensing nozzle member 116 is seated upon the spring washer 150 or the like. The undersurface portion of the circlip 154 is then engaged with the upper surface portion 156 of the hot melt adhesive dispensing nozzle member 116, and the circlip 154 and the hot melt adhesive dispensing nozzle member 116 are then depressed downwardly so as to effectively compress the spring washer 150 or the like in order to enable the circlip 154 to be snap fitted into the annular recess 152 defined within the inner peripheral wall portion of the nut member 118. When in fact the circlip 154 is disposed at a suitable elevation so as to permit the same to be axially aligned with the annular recess 152 defined within the inner peripheral wall portion of the nut member 118 and thereby snap-fitted into the annular recess 152 of the nut member 118 as a result of expanding radially outwardly from its radially contracted state, the downward pressure exerted upon the hot melt adhesive dispensing nozzle member 116 is then relieved so as to permit the spring washer 150 or the like to expand upwardly. In this manner, the hot melt adhesive dispensing nozzle member 116 will in effect be fixedly secured within the nut member 118 as a result of being fixedly retained between the circlip 154 and the spring washer 150 or the like.

The assembly comprising the hot melt adhesive dispensing nozzle member 116 and the nut member 118 is now ready to be mounted upon the hot melt adhesive dispensing module seat member 112. It will be recalled that in accordance with one unique feature characteristic of the present invention, the plurality of radially inwardly extending slots 134 have been formed within the annular flanged ring portion 132 of the hot melt adhesive dispensing module seat member 112, and in accordance with another unique feature characteristic of the present invention, a plurality of vertically or axially oriented pins 158, such as, for example, four pins, have their lower end portions fixedly mounted within a plurality of blind bores 160 which are respectively defined within upper regions of the hot melt adhesive dispensing nozzle member 116. The bores 160 are equiangularly spaced from each other in a circumferential array wherein the spacing defined between adjacent bores 160 is 90° such that the pins 158 will be disposed at angular positions which correspond with the slots 134 defined within the annular flanged ring portion 132 of the lower tubular body portion 130 of the hot melt adhesive dispensing module seat member 112. Accordingly, when the aforenoted assembly, comprising the hot melt adhesive dispensing nozzle member 116 and the nut member 118, is ready to be mounted upon the hot melt adhesive dispensing module seat member 112, the plurality of vertically oriented pins 158 are respectively aligned with and inserted into the plurality of slots 134 formed within the annular flanged ring portion 132 of the lower tubular body portion 130 of the hot melt adhesive dispensing module seat member 112.

The cooperating pins 158 and slots 134 serve several purposes as will now be discussed. It is to be noted at this point in time that the hot melt adhesive dispensing nozzle member 116 will be located at its uppermost position against the undersurface portion of the circlip 154 as a result of the upward biasing effect of the spring washer 150, and that the axial length of the vertically oriented pins 158 is such that the upper end portions of the vertically oriented pins 158 will in fact be engaged within the slots 134, formed within the annular flanged ring portion 132 of the lower tubular body portion 130 of the hot melt adhesive dispensing module seat member 112, just prior to the threaded engagement of the internally threaded portion 146 of the nut member 118 with the externally threaded annular ring portion 132 of the lower tubular body portion 130 of the hot melt adhesive dispensing module seat member 112. Accordingly, when the nut member 118 is rotated relative to the hot melt adhesive dispensing module seat member 112 so as to in fact ultimately achieve the threaded engagement between the internally threaded portion 146 of the nut member 118 and the externally threaded annular ring portion 132 of the lower tubular body portion 130 of the hot melt adhesive dispensing module seat member 112, one of the purposes of the vertically oriented pins 158 mounted upon hot melt adhesive dispensing nozzle member 116, and the corresponding slots 134 defined within the annular flanged ring portion 132 of the lower tubular body portion 130 of the hot melt adhesive dispensing module seat member 112, is to effectively prevent the hot melt adhesive dispensing nozzle member 116 from undergoing any rotation around the axis 162 of the hot melt adhesive dispensing module seat member 112 of the dispensing module 114.

Therefore, the predetermined orientation of the hot melt adhesive dispensing or discharge ports or passageways 140, 140, with respect to the hot melt adhesive dispensing module 114, can be maintained or retained so as to ensure that the proper or desired hot melt adhesive dispensing or discharge pattern of the hot melt adhesive material onto the underlying substrate is achieved. In connection with achieving a proper or desired hot melt adhesive dispensing or discharge pattern of the hot melt adhesive material onto an underlying substrate, the second purpose of the vertically oriented pins 158, mounted upon hot melt adhesive dispensing nozzle member 116, and the corresponding provision of the slots 134 defined within the annular flanged ring portion 132 of the lower tubular body portion 130 of the hot melt adhesive dispensing module seat member 112, will be apparent.

More particularly, by providing, for example, the four vertically oriented pins 158 upon the hot melt adhesive dispensing nozzle member 116, as well as the corresponding slots 134 defined within the annular flanged ring portion 132 of the lower tubular body portion 130 of the hot melt adhesive dispensing module seat member 112, it can be appreciated that depending upon which ones of the vertically oriented pins 158 are disposed within selected ones of the slots 134, the relative angular orientation of the hot melt adhesive dispensing or discharge ports or passageways 140, 140, with respect to the longitudinal axis 162 of the hot melt adhesive dispensing module 114 can be altered so as to, in turn, correspondingly alter the particular hot melt adhesive dispensing or discharge pattern to be deposited upon the underlying substrate. In other words, the provision of vertically oriented pins 158 and the corresponding slots 134 serves as an indexing means for altering the relative disposition of the hot melt adhesive dispensing or discharge ports or passageways 140, 140, with respect to the longitudinal axis 162 of the hot melt adhesive dispensing module 114. It can therefore be appreciated still further that while four orientation pins 158, and four corresponding slots 134, have been disclosed wherein the pins 158 and slots 134 are cirucmferentially spaced equiangularly apart through angular distances of 90°, a larger number, or smaller number, of orientation pins and slots could of course be utilized with corresponding equiangular spacing defined therebetween so as to achieve different indexing capabilities. It is noted still further that if the pins 158 and slots 134 are not equiangularly spaced with respect to each other, but are in fact formed respectively within the hot melt adhesive dispensing nozzle member 116 and the lower tubular body portion 130 of the hot melt adhesive dispensing module seat member 112 in a non-symmetrical manner, then such pattern mandates that the hot melt adhesive dispensing nozzle member 116 can only be mounted upon the lower tubular body portion 130 of the hot melt adhesive dispensing module seat member 112 in a predetermined manner. This ensures that the predeterminedly desired hot melt adhesive dispensing or discharge pattern onto the underlying substrate will be achieved.

It is noted still further in accordance with the foregoing, that, as a result of the pre-assembly of the hot melt adhesive dispensing nozzle member 116 into and with the nut member 118 by means of, and along with, the circlip 154 and the spring washer 150 or the like, when in fact the nut member 118 is to be rotated relative to the hot melt adhesive dispensing module seat member 112 so as to in fact achieve the threaded engagement between the internally threaded portion 146 of the nut member 118 and the externally threaded annular ring portion 132 of the lower tubular body portion 130 of the hot melt adhesive dispensing module seat member 112, such rotation of the nut member 118 can be effected either manually or by means of the use of a single tool without any regard to using a tool or manual means to restrain any rotational movement of the hot melt adhesive dispensing nozzle member 116 with respect to the longitudinal axis 162 of the hot melt adhesive dispensing module 114 due to the aforenoted presence and disposition of the vertically oriented pins 158. Accordingly, the installation of the hot melt adhesive dispensing nozzle member 116 upon the hot melt adhesive dispensing module 114 is substantially simplified and rendered less tedious and time-consuming for installation personnel as compared to conventional prior art systems and installation techniques.

It is also noted that when the nut member 118 is fully or completely threadedly engaged upon the externally threaded annular ring portion 132 of the lower tubular body portion 130 of the hot melt adhesive dispensing module seat member 112, as illustrated in FIG. 4, the upper surface portion 156 of the hot melt adhesive dispensing nozzle member 116 will be seated and supported upon the lower surface or undersurface portion 163 of the lower tubular body portion 130 of the hot melt adhesive dispensing module seat member 112, and that the spring washer 150 will possibly undergo some axial compression due to the axial translation of the hot melt adhesive dispensing nozzle member 116 with respect to the nut member 118 as a result of the aforenoted threaded engagement of the nut member 118 upon the externally threaded annular ring portion 132 of the lower tubular body portion 130 of the hot melt adhesive dispensing module seat member 112. It is noted still further that if for some reason the upper surface portion 156 of the hot melt adhesive dispensing nozzle member 116 is not in fact seated and supported upon the lower surface or undersurface portion 163 of the lower tubular body portion 130 of the hot melt adhesive dispensing module seat member 112 when the nut member 118 is fully or completely threadedly engaged upon the externally threaded annular ring portion 132 of the lower tubular body portion 130 of the hot melt adhesive dispensing module seat member 112, a suitable O-ring sealing member, not shown, may be disposed at the interface defined between the upper surface portion 156 of the hot melt adhesive dispensing nozzle member 116 and the lower surface or undersurface portion 163 of the lower tubular body portion 130 of the hot melt adhesive dispensing module seat member 112.

It is lastly noted that a single appropriate tool, such as, for example, a suitable wrench or the like, can be utilized to rotate the nut member 118 relative to the hot melt adhesive dispensing module seat member 112 so as to in fact achieve the threaded engagement between the internally threaded portion 146 of the nut member 118 and the externally threaded annular ring portion 132 of the lower tubular body portion 130 of the hot melt adhesive dispensing module seat member 112, however, in lieu of utilizing such a single tool, the nut member 118 may simply be manually rotated relative to the hot melt adhesive dispensing module seat member 112 so as to in fact achieve the threaded engagement between the internally threaded portion 146 of the nut member 118 and the externally threaded annular ring portion 132 of the lower tubular body portion 130 of the hot melt adhesive dispensing module seat member 112. It is of course to be appreciated further, however, that in view of the fact that hot fluids or hot materials, in the form of, for example, hot melt adhesive materials, are being conveyed through the hot melt adhesive dispensing nozzle member 116, and that the heat from such fluids or materials will be conducted to the nut member 118, the nut member 118 will exhibit substantially elevated temperatures.

Accordingly, when, for example, a particular hot melt adhesive dispensing nozzle member 116 is to be removed from the hot melt adhesive dispensing module 114 and replaced with another hot melt adhesive dispensing nozzle member 116 so as to, for example, alter the particular hot melt adhesive deposition pattern onto the underlying substrate, manual unthreading and removal of the nut member 118 and the hot melt adhesive dispensing nozzle member 116, in effect, as an integral assembly, from the externally threaded annular ring portion 132 of the lower tubular body portion 130 of the hot melt adhesive dispensing module seat member 112 would not be advisable in view of the potential for severe skin burns to occur when the hands and fingers of the installation personnel came into contact with the heated hot melt adhesive dispensing nozzle and nut members 116, 118. Therefore, in accordance with a last unique feature characteristic of the present invention, a thermal protective ring member 164, fabricated from a suitable plastic material, such as, for example, a polyetheretherketone (PEEK) polymer, is fixedly secured upon the outer periphery of the nut member 118 by means of, for example, an interference fit, a shrink fitting, an embedding of the O-ring member within knurled regions upon the outer peripheral surface of the nut member 118, or the like. Accordingly, the nut member 118 may be manually manipulated without exposing the installation or operator personnel to any thermal hazards. It is noted still further that the thermal protective ring member 164 may be fabricated in different colors. Therefore, the thermal protective ring member 164 may be utilized to effectively color-code individual hot melt adhesive dispensing nozzle and nut member assemblies 116, 118 whereby, as a result of simply looking at the particularly colored thermal protective ring member 164, the installation personnel will know what particular hot melt adhesive dispensing nozzle member 116 is incorporated within the selected hot melt adhesive dispensing nozzle and nut member assembly 116, 118 such that a particular hot melt adhesive deposition pattern can be achieved, or that the particular hot melt adhesive dispensing nozzle member 116 has predeterminedly sized hot melt adhesive dispensing or discharge passageways or ports 140, 140, or the like.

Thus, it may be seen that in accordance with the principles and teachings of the present invention, there has been provided a new and improved quick installation hot melt adhesive dispensing nozzle assembly, for use in connection with hot melt adhesive dispensing modules, wherein the nut member, which is adapted to threadedly engage the hot melt adhesive dispensing module seat member, and the hot melt adhesive dispensing nozzle member are initially assembled together such that the nut and nozzle members cannot be readily or easily separated from each other. A plurality of orientation pins are adapted to effectively interconnect the hot melt adhesive nozzle member to the dispensing module seat member such that a particular angular orientation of the hot melt adhesive dispensing nozzle member, and therefore the angular orientation of the hot melt adhesive dispensing ports defined within the nozzle member, may be predeterminedly chosen, selected, and set with respect to the longitudinal axis of the hot melt adhesive dispensing module, and the nut member is rotatable relative to the hot melt adhesive dispensing nozzle member such that the nut member can be threadedly engaged upon the hot melt adhesive dispensing module seat member while the angular orientation or disposition of the nozzle member is maintained at its predetermined or preset position or setting, with respect to the longitudinal axis of the hot melt adhesive dispensing module, as a result of the interconnection effectively defined between the hot melt adhesive dispensing nozzle member and the hot melt adhesive dispensing module seat member by means of the aforenoted orientation pins. In this manner, only the nut member needs to be grasped either manually, or by means of a single tool, in order to achieve the fixed installation of the nozzle member upon the hot melt adhesive dispensing module.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A quick installation fluid dispensing nozzle assembly for mounting upon a fluid dispensing module having a longitudinal axis, comprising:

a fluid dispensing nozzle member adapted to be disposed in fluidic communication with a fluid dispensing module so as to receive a fluid, to be dispensed, from the fluid dispensing module, said fluid dispensing nozzle member having at least one fluid dispensing discharge port formed therein for discharging the fluid in accordance with a predetermined pattern;

an annular nut member having means disposed thereon for effectively engaging a first portion of said fluid dispensing nozzle member so as to prevent the separation of said fluid dispensing nozzle member from said annular nut member in a first direction, and thread means formed upon a first internal peripheral wall portion for threadedly engaging the fluid dispensing module;

means, mounted upon said annular nut member, for engaging a second portion of said fluid dispensing nozzle member so as to prevent the separation of said fluid dispensing nozzle member from said annular nut member in a second opposite direction with respect to said first direction whereby said fluid dispensing nozzle member will be retained internally within said annular nut member so as to form an integral assembly with said annular nut member whereby said integral assembly, comprising said fluid dispensing nozzle member and said annular nut member, can be fixedly mounted upon the fluid dispensing module as a result of said annular nut member being threadedly engaged upon the fluid dispensing module; and means, mounted upon said fluid dispensing nozzle member, for interconnecting said fluid dispensing nozzle member with the fluid dispensing module, such that while said annular nut member is being threadedly engaged upon the fluid dispensing module, said fluid dispensing nozzle member will be prevented from undergoing rotation with respect to the fluid dispensing module whereby the orientation of said at least one fluid dispensing discharge port, formed within said fluid dispensing nozzle member, is maintained with respect to the longitudinal axis of the fluid dispensing module so as to preserve said predetermined fluid dispensing pattern.

2. The nozzle assembly as set forth in claim 1, wherein said means, mounted upon said annular nut member, for engaging said second portion of said fluid dispensing nozzle member so as to prevent the separation of said fluid dispensing nozzle from said annular nut member in said second direction, comprises:

an annular recess defined within a second internal peripheral wall portion of said annular nut member; and a circlip mounted within said annular recess defined within said second internal peripheral wall portion of said annular nut member and engageable with said fluid dispensing nozzle member.

3. The nozzle assembly as set forth in claim 2, further comprising:

an annular spring member disposed upon said annular nut member and engaged with said fluid dispensing nozzle member for biasing said fluid dispensing nozzle member toward said circlip.

4. The nozzle assembly as set forth in claim 3, wherein:

said annular spring member comprises a spring washer.

5. The nozzle assembly as set forth in claim 1, wherein said means, mounted upon said fluid dispensing nozzle member, for interconnecting said fluid dispensing nozzle member with the fluid dispensing module, comprises:

a plurality of orientation pins mounted upon said fluid dispensing nozzle member and adapted to be engaged with the fluid dispensing module so as to prevent angular rotation of said fluid dispensing nozzle member with respect to the longitudinal axis of the fluid dispensing module as said nut member is threadedly engaged upon the fluid dispensing module.

6. The nozzle assembly as set forth in claim 5, wherein:

said plurality of orientation pins comprises four pins equlangularly spaced apart from each other through angular distances of 90°.

7. The nozzle assembly as set forth in claim 5, wherein:

particular ones of said plurality of orientation pins mounted upon said fluid dispensing nozzle member can be selectively disposed at different angular positions within the fluid dispensing module so as to indexably dispose said fluid dispensing nozzle member, and said at least one fluid dispensing discharge port formed within said fluid dispensing nozzle, with respect to the fluid dispensing module so as to selectively alter the fluid dispensing pattern.

8. The nozzle assembly as set forth in claim 5, wherein:

particular ones of said plurality of orientation pins mounted upon said fluid dispensing nozzle member can be selectively disposed at particular angular positions within the fluid dispensing module so as to predeterminedly dispose said fluid dispensing nozzle member, and said at least one fluid dispensing discharge port formed within said fluid dispensing nozzle, with respect to the fluid dispensing module so as to predeterminedly ensure a particular fluid dispensing pattern.

9. The nozzle assembly as set forth in claim 1, wherein:

said fluid dispensing nozzle member comprises a hot melt adhesive fluid dispensing nozzle member for dispensing hot melt adhesive material onto an underlying substrate.

10. The nozzle assembly as set forth in claim 9, further comprising:

a thermal protective ring member disposed upon an external peripheral surface portion of said nut member for permitting said nut member to be threadedly disengaged from the fluid dispensing module by personnel without exposing the personnel to thermal hazards.

11. The nozzle assembly as set forth in claim 10, wherein:

said thermal protective ring member is fabricated from a polyetheretherketone (PEEK) polymer.

12. The nozzle assembly as set forth in claim 11, wherein:

said thermal protective ring member, fabricated from said polyetheretherketone (PEEK) polymer, is fabricated in different colors such that different nozzle assemblies can be color-coded so as to indicate to personnel different nozzle assemblies having different fluid dispensing patterns.

13. The nozzle assembly as set forth in claim 1, wherein:

said means, disposed upon said annular nut member for effectively engaging said first portion of said fluid dispensing nozzle member so as to prevent the separation of said fluid dispensing nozzle member from said annular nut member in said first direction, comprises a radially inwardly extending flange portion integrally formed upon said annular nut member.

14. A quick installation fluid dispensing nozzle assembly for mounting upon a fluid dispensing module, comprising:

a fluid dispensing module seat member adapted to be fixedly mounted upon the fluid dispensing module, having a longitudinal axis, and having first thread means formed upon an external peripheral portion thereof;

a fluid dispensing nozzle member adapted to be disposed in fluidic communication with a fluid dispensing module so as to receive a fluid, to be dispensed, from the fluid dispensing module, said fluid dispensing nozzle member having at least one fluid dispensing discharge port formed therein for discharging the fluid in accordance with a predetermined pattern;

an annular nut member having means disposed thereon for effectively engaging a first portion of said fluid dispensing nozzle member so as to prevent the separation of said fluid dispensing nozzle member from said annular nut member in a first direction, and thread means formed upon a first internal peripheral wall portion for threadedly engaging the fluid dispensing module;

means, mounted upon said annular nut member, for engaging a second portion of said fluid dispensing nozzle member so as to prevent the separation of said fluid dispensing nozzle member from said annular nut member in a second opposite direction with respect to said first direction whereby said fluid dispensing nozzle member will be retained internally within said annular nut member so as to form an integral assembly with said annular nut member whereby said integral assembly, comprising said fluid dispensing nozzle member and said annular nut member, can be fixedly mounted upon the fluid dispensing module as a result of said annular nut member being threadedly engaged upon the fluid dispensing module; and means, mounted upon said fluid dispensing nozzle member, for interconnecting said fluid dispensing nozzle member with the fluid dispensing module, such that while said annular nut member is being threadedly engaged upon the fluid dispensing module, said fluid dispensing nozzle member will be prevented from undergoing rotation with respect to the fluid dispensing module whereby the orientation of said at least one fluid dispensing discharge port, formed within said fluid dispensing nozzle member, is maintained with respect to the longitudinal axis of the fluid dispensing module so as to preserve said predetermined fluid dispensing pattern.

15. The nozzle assembly as set forth in claim 14, wherein said means, mounted upon said annular nut member, for engaging said second portion of said fluid dispensing nozzle member so as to prevent the separation of said fluid dispensing nozzle from said annular nut member in said second direction, comprises:

an annular recess defined within a second internal peripheral wall portion of said annular nut member; and a circlip mounted within said annular recess defined within said second internal peripheral wall portion of said annular nut member and engageable with said fluid dispensing nozzle member.

16. The nozzle assembly as set forth in claim 15, further comprising:

an annular spring member disposed upon said annular nut member and engaged with said fluid dispensing nozzle member for biasing said fluid dispensing nozzle member toward said circlip.

17. The nozzle assembly as set forth in claim 16, wherein:

said annular spring member comprises a spring washer.

18. The nozzle assembly as set forth in claim 14, wherein said means for interconnecting said fluid dispensing nozzle member with the fluid dispensing module, comprises:

a plurality of slots formed within said fluid dispensing module seat member; and a plurality of orientation pins mounted upon said fluid dispensing nozzle member for engagement with said plurality of slots formed within said fluid dispensing module seat member so as to prevent angular rotation of said fluid dispensing nozzle member with respect to said longitudinal axis of said fluid dispensing module seat member as said nut member is threadedly engaged upon said fluid dispensing module seat member.

19. The nozzle assembly as set forth in claim 18, wherein:

said plurality of slots formed within said fluid dispensing module seat member comprises four slots equiangularly spaced apart from each other through angular distances of 90° around said longitudinal axis of said fluid dispensing module seat member; and said plurality of orientation pins mounted upon said fluid dispensing nozzle member comprises four pins equiangularly spaced apart from each other through angular distances of 90° for respective disposition within said plurality of slots formed within said fluid dispensing module seat member.

20. The nozzle assembly as set forth in claim 19, wherein:

particular ones of said plurality of orientation pins mounted upon said fluid dispensing nozzle member can be selectively disposed within particular ones of said plurality of slots formed within said fluid dispensing module seat member so as to indexably dispose said fluid dispensing nozzle member, and said at least one fluid dispensing discharge port formed within said fluid dispensing nozzle, with respect to said longitudinal axis of said fluid dispensing module seat member so as to selectively alter the fluid dispensing pattern.

21. The nozzle assembly as set forth in claim 18, wherein:

particular ones of said plurality of orientation pins mounted upon said fluid dispensing nozzle member can be selectively disposed at particular angular positions within the fluid dispensing module so as to predeterminedly dispose said fluid dispensing nozzle member, and said at least one fluid dispensing discharge port formed within said fluid dispensing nozzle, with respect to the fluid dispensing module so as to predeterminedly ensure a particular fluid dispensing pattern.

22. The nozzle assembly as set forth in claim 14, wherein:

said fluid dispensing nozzle member comprises a hot melt adhesive fluid dispensing nozzle member for dispensing hot melt adhesive material onto an underlying substrate.

23. The nozzle assembly as set forth in claim 22, further comprising:

a thermal protective ring member disposed upon an external peripheral surface portion of said nut member for permitting said nut member to be threadedly disengaged from the fluid dispensing module by personnel without exposing the personnel to thermal hazards.

24. The nozzle assembly as set forth in claim 23, wherein:

said thermal protective ring member is fabricated from a polyetheretherketone (PEEK) polymer.

25. The nozzle assembly as set forth in claim 24, wherein:

said thermal protective ring member, fabricated from said polyetheretherketone (PEEK) polymer, is fabricated in different colors such that different nozzle assemblies can be color-coded so as to indicate to personnel different nozzle assemblies having different fluid dispensing patterns.

26. The nozzle assembly as set forth in claim 14, wherein:

said means, disposed upon said annular nut member for effectively engaging said first portion of said fluid dispensing nozzle member so as to prevent the separation of said fluid dispensing nozzle member from said annular nut member in said first direction, comprises a radially inwardly extending flange portion integrally formed upon said annular nut member.

* * * * *